United States Patent [19]

Iwai et al.

[11] Patent Number: 4,648,731

[45] Date of Patent: Mar. 10, 1987

[54] ERROR CORRECTION MEMBER POSITIONING SYSTEM FOR A PRINTER

[75] Inventors: Hiroji Iwai, Yamatokoriyama; Koji Yamaji, Nara, both of Japan

[73] Assignee: Sharp Kabushiki Kaisha, Osaka, Japan

[21] Appl. No.: 706,082

[22] Filed: Feb. 27, 1985

[30] Foreign Application Priority Data

Feb. 27, 1984 [JP] Japan ..... 59-37167

[51] Int. Cl.[4] ..... B41J 35/10

[52] U.S. Cl. ..... 400/240.1; 400/74

[58] Field of Search ..... 400/70, 74, 240.1

[56] References Cited

U.S. PATENT DOCUMENTS

| | | | |
|---|---|---|---|
| 3,500,437 | 3/1970 | Foerster | 400/74 X |
| 3,729,081 | 4/1973 | Ozimek et al. | 400/240.1 X |
| 3,747,734 | 7/1973 | Norman et al. | 400/240.1 X |
| 3,799,316 | 3/1974 | Davidge et al. | 400/240.1 X |
| 3,834,512 | 9/1974 | Haugen | 400/240.1 X |
| 3,866,736 | 2/1975 | Ozimek et al. | 400/240.1 X |
| 3,882,990 | 5/1975 | Genesio | 400/240.1 X |
| 3,980,171 | 9/1976 | Frechette | 400/240.1 X |
| 3,991,874 | 11/1976 | Klem | 400/240.1 X |
| 4,178,108 | 12/1979 | Kane | 400/74 X |
| 4,384,797 | 5/1983 | Anderson et al. | 400/240.1 X |

FOREIGN PATENT DOCUMENTS

| | | | |
|---|---|---|---|
| 43433 | 1/1982 | European Pat. Off. | 400/240.1 |
| 2201087 | 10/1973 | Fed. Rep. of Germany | 400/240.1 |

*Primary Examiner*—Charles A. Pearson
*Assistant Examiner*—James R. McDaniel
*Attorney, Agent, or Firm*—Birch, Stewart, Kolasch and Birch

[57] ABSTRACT

A correction member driving system for a printer in which an error such as a mistyped character on a recording member is erased by an error correction member in a sequence comprising the steps of positioning a correction member at a position operatively aligned with the printing error, typing a type character corresponding to the error through the error correction member on the recording member to thereby erase the error, and separating the error correction member from the recording member by automatically forwarding the error correction member by a predetermined distance. The preferred embodiment further comprises the steps of automatically backspacing the error correction member to the erase position, and returning the error correction member to a storage position.

3 Claims, 5 Drawing Figures

ERROR CORRECTION MEMBER POSITIONING SYSTEM FOR A PRINTER

BACKGROUND OF THE INVENTION

The present invention relates to an error correction device for a printer and, more particularly, to an error correction member positioning system for an error correction device in a printer which smoothly detaches an error correction member from a recording paper after erasing an error such as a mistyped character.

In conventional typewriters, various types of error correction devices have been developed for correcting errors such as mistyped characters. In general, the conventional error correction devices are operated as follows. First, a carriage carrying a printing head and the error correction device is returned at the position of a mistyped character on a recording paper by operating a back space mechanism. When the carriage reaches the position of the mistyped character, a specific key such as an erase key is depressed so that a printing type character corresponding to the mistyped character is selected from the type wheel (or an erase printing type is selected). At the same time, an error correction tape of the error correction device is lifted up to a correcting position from a normal position, and thereafter, the selected printing type is typed over mistyped character through the error correction tape, so that the mistyped character is erased.

Two types of error correction tapes are generally used for erasing the mistyped character. One is a correction tape having an adhesive material on its surface. The erasing of the mistyped character is excuted in such a manner that the ink, which forms the mistyped character, on the recording paper is removed from the recorded paper by typing the selected printing type character corresponding to the mistyped character. Because the ink on the recorded paper adheres to the adhesive material of the error correction tape, the ink is removed from the recording paper erasing the mistyped character. A second type of error correction tape includes adhesive, white pigments. The erasing of the mistyped character is excuted in such a manner that the adhesive white, pigments are attached to the typed ink on the recording paper when pressing the recording paper against the error correction tape with the selected printing type character.

After erasing the mistyped character, the error correction tape is directly moved down from the correcting position to the normal position. Following the down movement of the error correction tape, a correct printing type character corresponding to a desired character is selected and is typed, so that the correct character is typed through an ink ribbon on the position at which the mistyped character was present. The erasing operation of the error correction tape is thereby completed.

Conventionally, as soon as the error correction tape is lifted up at the correcting position and the mistyped character is erased by typing the selected printing type character through the error correction tape, the error correction tape is directly moved down. Accordingly, as shown in FIG. 1, a tape surface 2 of the error correction tape 1 which is depressed for erasing the mistyped character may become rumpled. Tension rollers 3 and 4 are provided for tensioning the error correction tape 1 in the horizontal direction. The ends of the error correction tape 1 are connected to a tape supply spool at the side of the tension roller 3 and a tape storing spool at the side of the tension roller 4.

The reason why the error correction tape may become rumpled is as follows: When the tape surface 2 carrying the adhesive, material or the adhesive white pigments is pressed into contact with the recorded paper by impacting the recording paper with the selected printing character type, the recording paper and the tape surface 2 are attached. In this condition, the error correction tape 1 is directly moved down and is forcibly removed from the recording paper. Therefore, because the tape surface 2 may become rumpled, the following problems may happen. When removing the tape surface 2 from the recording paper, the printing type character of the type wheel may become caught in the rumpled tape surface 2. Also, the error correction tape 1 may not move smoothly down, and further, may not be smoothly wound by the tape storing spool. Accordingly, the above problems impair the operation of the printer.

SUMMARY OF THE INVENTION

Accordingly, it is an object of the present invention to provide an improved error correction member drive system for a printer which enables a suitable error correcting operation of an error correction device in the printer.

It is another object of the present invention to provide an improved error correction member drive system in a printer which quickly carries out the movements of the error correction member without impairing the printing operation of the printer.

It is still another object of the present invention to provide an improved error correction member drive system in a typewriter which enables a suitable error correction of an error correction device without damaging the printing operation of the typewriter.

It is a further object of the present invention to provide an improved error correction member drive system in a printer for automatically separating a correction member from a recording paper after a mistyped character is removed from the typed paper, in such a manner that the correction member is automatically forwarded and backed spaced by the same distance.

Other objects and further scope of applicability of the present invention will become apparent from the detailed description given hereinafter. It should be understood, however, that the detailed description of and specific examples, while indicating preferred embodiments of the invention, are given by way of illustration only, since various changes and modifications within the spirit and scope of the invention will become apparent to those skilled in the art from this detailed description.

To achieve these objects, according to an embodiment of the present invention, a correction member drive system for a printer in which an error such as a mistyped character on a recorded member is erased by an error correction member comprises means for positioning a correction member at a first position, means for typing a type character corresponding to the character typed in error through the error correction member on the recording member to thereby erase the error, means for separating the error correction member from the recording member, and means for automatically forwarding the error correction member by a predetermined distance.

The preferred embodiment further comprises means for automatically backing the error correction member up to the erased position, and means for positioning the error correction member at normal storage position.

BRIEF DESCRIPTION OF THE DRAWINGS

The present invention will be better understood from the detailed description given hereinbelow and the accompanying drawings which are given by way of illustration only, and thus are not limitative of the present invention and wherein.

DETAILED DESCRIPTION OF THE INVENTION

Figure 1:
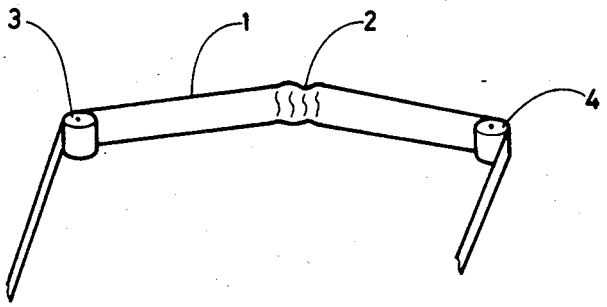
FIG. 1 is a perspective view of an error correction tape, illustrating the rumpled condition that occurs in conventional error correction member drive systems.
Figure 3:
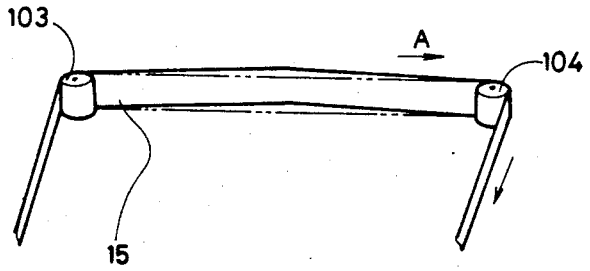
FIG. 3 is a perspective view of an error correction member used in the typewriter of FIG. 2.
Figure 2:
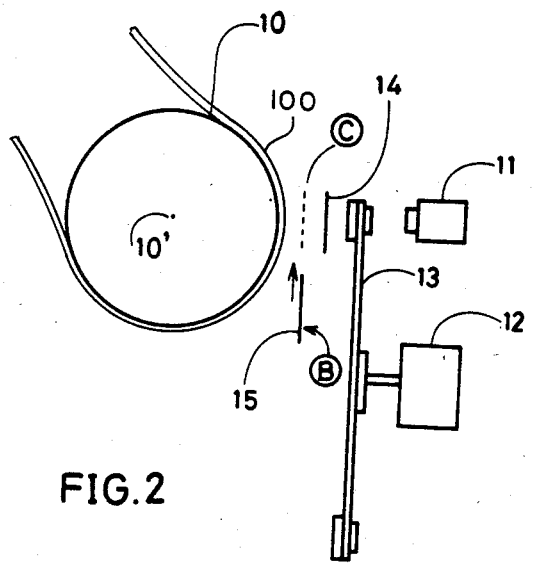
FIG. 2 is a side elevational view of a typewriter including an error correction device according to a preferred embodiment of the present invention.

FIG. 2 shows in side elevation a typewriter including an error correction device according to a preferred embodiment of the present invention. FIG. 3 shows in perspective an error correction member used in the typewriter of FIG. 2.

In the typewriter of FIGS. 2 and 3, a platen 10 is rotatably provided around an axis 10'. A recording paper 100 is inserted from a paper inserting section at the back side and the upper side of the platen 10 and is forwarded to a printing position facing a printing device. The recording paper 100 is forwarded along the surface of the platen 10 by rotation of the platen 10.

Under the platen 10, a plurality of feed rollers (not shown) are rotatably provided around an axis parallel with the axis 10' of the platen 10 and are in contact with the surface of the platen 10, so that the recording paper 100 is sandwiched between the platen 10 and the feed rollers. A plurality of paper pressing rollers (not shown) are rotatably provided around an axis parallel with the axis 10' of the platen 10. The recording paper 100 is pressed on the platen 10 by the plurality of paper pressing rollers so as to position the recording paper 100 at the printing position. After printing, the recorded paper 100 is taken from the paper take-out portion at the front side and the upper side of the platen 10.

A carriage carries the printing device, an ink ribbon 14, and an error correction device including an error correction tape 15, and reciprocates along an axis parallel with the axis 10' of the platen 10. The printing device includes a type wheel 13, a hammer 11, and a driving motor 12. The type wheel 13 has a plurality of different printing types, and is rotated around an axis connected to a rotating axis of the driving motor 12. Each of the printing types corresponds to each of the keys on the keyboard. The hammer 11 hits a printing type character selected in response to the actuation of a key of the keyboard 20 to print a character corresponding to the selected printing type character on the recording paper 100.

The ink of the ink ribbon 14 prints the character by impacting the selected printing type character from the type wheel 13 against the ink ribbon 14 by the hammer 11. The error correction device includes an error correction tape 15, tape tension rollers 103 and 104, a tape supply spool, a tape storing spool, a tape lift up/down mechanism, and a tape winding mechanism. The error correction tape 15 is impacted against the printing type character of the type wheel 13 by the hammer 11 so as to remove the ink character from the recording paper 100. The error correction tape 15 is extended by the tension rollers 103 and 104 in the horizontal direction. One end of the error correction tape 15 is connected to the tape supply spool, and the other end of the error correction tape 15 is connected with the tape storing spool. The tape supply spool 104 is operated by the winding mechanism for winding the error correction tape 15. The error correction tape 15 is wound in the arrow direction A. The error correction tape is lifted up and moved down by the lift up/down mechanism. The error correction tape 15 is moved between a normal, storage position B and a correcting position C by the tape lift up/down mechanism. In the normal printing mode of the printer, the error correction tape 15 is set at the normal position B. In the error correction mode of the printer, the correction tape 15 is set at the correcting position C.

The operation of the error correction device will now be described with reference to FIGS. 3, 4, and 5.

Figure 4:
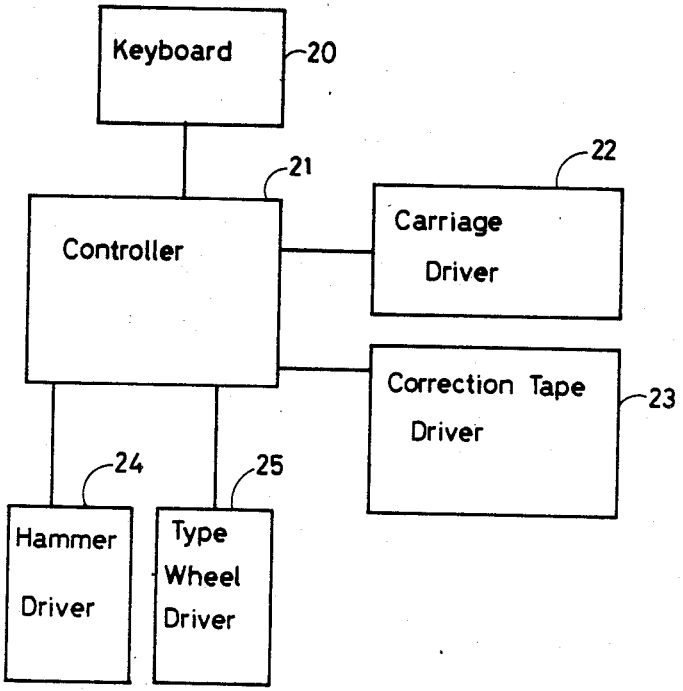
FIG. 4 is a block diagram for a control circuit of the typewriter of FIG. 2.
Figure 5:
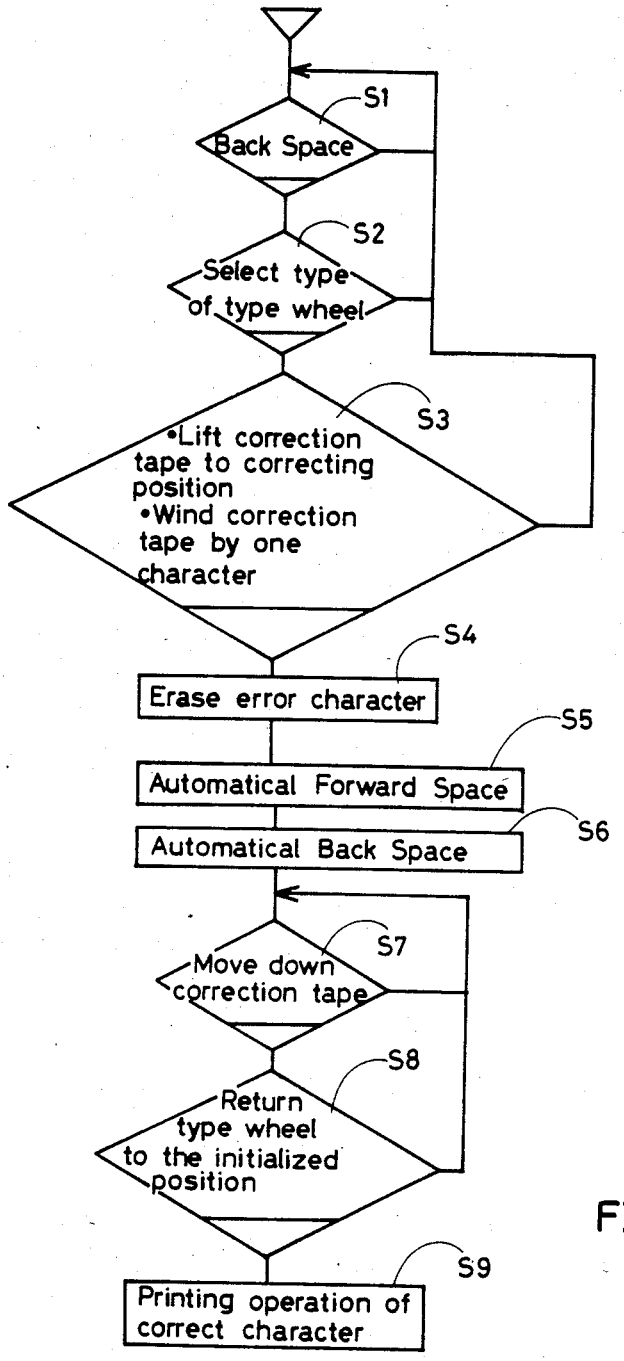
FIG. 5 is a flowchart of the operation of the error correction device.

In FIG. 4, a keyboard 20 includes a plurality of different character keys. The signal corresponding to the depressed key is inputted to the controller 21. The type wheel 13 is driven by a wheel driver 25 to select one of the printing type characters corresponding to the depressed key in response to the controller 21. The hammer 11 is driven by a hammer driver 24 in response to signals from the controller 21, so that the selected printing type is hit by the hammer 11. The carriage is moved by a carriage driver 22 by the controller 21 so that the carriage reciprocates along the platen 10. The error correction tape 15 is moved up and down by the lift up/down mechanism driven by the correction tape driver 23 according to the controller 21. The tape storing spool at the side of the tension roller 104 is rotated by a winding driver.

In the present invention, after the error correction tape 15 is placed in contact with the recording paper 100 during an erasing operation (In this condition, the error correction tape 15 is indicated by a dotted line), the error correction tape 15 with the carriage is forwarded in the direction A (or in the horizontal direction) so that the error correction tape 15 is separated from the recording paper 100. Thereafter, the error correction tape 15 is moved down to the normal, storage position B.

Further, the error correcting operation of the error correction device when the mistyped character is erased will be described with reference to the flowchart of FIG. 5.

Step S1:

The carriage is returned at the position of the mistyped character by a back space mechanism (or a forward space mechanism). The back space mechanism is responsive to a signal outputted from the controller 21 by depressing a back space key of the keyboard 20. The carriage is moved by the carriage driver 22 in response to the controller 21.

Step S2:

The same printing type chamber as the mistyped character is selected from the plurality of printing type characters of the type wheel 13. Instead of using the same type character as the mistyped character, an erase-purpose printing element can be operated. The printing type character is selected by pressing a specific key such as an erase key on the keyboard 20.

Step S3:

When the specific key such as the erase key of the keyboard 20 is depressed, the output signal from the keyboard 20 is inputted in the controller 21. The correction tape driver 23 is driven in response to the output of the controller 21, so that the error correction tape 15 is lifted up to the correcting position C, and is wound by one character space by the tape storing spool.

Step 4:

After the error correction tape 15 is lifted up, the hammer driver 24 and the type wheel driver 25 are operated by the controller 21, so that the error correction tape 15 is pressed against the recording paper 100 by impacting the selected printing type character through the error correction tape 15 by the hammer 11, so that the printed character is removed from the recording paper 100.

Step 5:

After the mistyped character is thus erased, the carriage driver 22 is moved in response to signals from the controller 21. The carriage carrying the printing device and the error correction device is automatically moved in the horizontal direction (in the arrow direction A) by a predetermined distance to thereby separate the error correction tape 15 from the recording paper 100. The carriage is automatically moved in the winding direction of the error correction tape 15.

In this case, probably, only the error correction tape 15 need be moved in the direction A without moving the carriage. However, the movement of only the correction tape 15 causes a large load to the tape winding operation. Therefore, the tape winding mechanism is required to withstand a load more than the load applied from the movement of the error correction tape 15. The cost of the tape winding mechanism may be increased.

Because the error correction device with the carriage is automatically moved in the correction tape winding direction by the predetermined distance, the error correction tape 15 is easily separated from the recorded paper 100. Any additional mechanism need not be provided for the above purpose. Because the error correction tape 15 is moved in the horizontal direction to cause detachment from the recording paper 100, the error correction tape 15 does not become rumpled.

Step S6:

After the carriage is automatically forwarded by the predetermined distance to detach the error correction tape 15 from the recording paper 100, the carriage with the error correction device is automatically returned to the erase position by the predetermined distance according to the controller 21.

Step S7:

After the carriage is returned to the erase position, the error correction tape 15 is moved down from the correcting position C to the normal position B. The lift up/down mechanism of the error correction device is driven by the error correcting tape driver 23 according to signals from the controller 21. When the error correction tape 15 is moved down, the error correction tape 15 and the recording paper 100 have previously been detached from each other, so that the downward movement of the error correction tape 15 is smoothly carried out.

Step S8:

The type wheel 13 is set at the initialized position. The type wheel 13 is driven by the type wheel driver 25 according to the controller 21.

Step S9:

A correct character is typed by hitting a desired character key selected from the type wheel 13 and the keyboard 20. The selected printing type character is hit by the hammer 11 against the ink ribbon 14. The hammer 11 is driven by the hammer driver 24. The correct character is typed at the mistyped position on the recording paper 100. The error correcting operation is completed.

In the preferred embodiment, the carriage is automatically forwarded by the predetermined distance in the arrow direction A by the forward space operation after the erasing operation, and thereafter, the carriage is automatically moved back by the back space operation. For this purpose, the spool at the side of the tension roller 104 is operated as the tape storing spool. If the spool at the side of the tension roller 103 is operated as the tape storing spool, the carriage may be automatically moved back by the predetermined distance after the erasing operation, and thereafter, the carriage may be automatically forwarded to the erase position.

As described above, in accordance with the present invention, after the erasing operation, the carriage carrying the error correction tape is automatically forwarded in the direction of the winding of the correction tape to thereby separate the error correcting tape from the recording paper, and thereafter, the carriage is automatically moved back at the erased position. The error correction tape is moved down to the normal position when the carriage reaches at the erase position. Therefore, the error correction tape is smoothly separated from the recorded paper. The surface of the correction tape cannot become rumpled when the surface of the error correction tape is separated from the recording paper. Furthermore, the downward movement of the error correction tape is smoothly carried out.

A character erasing ribbon which erases the typed character may be used in place of the error correction tape.

The present invention is not limited to a typewriter, and can be applied to various printers.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In an impact printer apparatus for printing selected type characters on a recording medium by impacting selected type character elements against the recording medium through an inked ribbon at a strike position, the type character elements being mounted on a carriage movable horizontally with respect to the recording medium, error correction means for erasing errors in typed characters printed on the recording medium including an error correcting tape extending along the direction of carriage movement horizontally of the recording medium between spaced tension rollers, the improvement comprising:

(a) means for transversely moving the correcting tape and associated tension rollers from a storage position vertically below the strike position on the recording medium at which a type character error exists, into vertical alignment therewith;

(b) means for impacting a selected character type element against the error correcting tape to erase the error on the recording medium;

(c) means for longitudinally moving the error correcting tape horizontally of the recording medium after the error has been erased while precluding vertical movement of the tape so as to separate the correcting tape from the recording medium, said means for longitudinally moving said error correcting tape first moving said tape in a forward printing direction and then moving said tape in a back space direction; and (d) means for transversely returning the correcting tape and associated tension rollers in a downward direction vertically of the recording medium to the storage position.

2. The printer apparatus of claim 1 wherein said error correcting means is mounted for movement with said carriage and said means for longitudinally moving said error correcting tape moves said carriage longitudinally while the tape remains stationary with respect to the tension rollers.

3. In an impact printer apparatus for printing selected type characters on a recording medium by impacting selected type character elements against the recording medium through an inked ribbon at a strike position, the type character elements being mounted on a carriage movable horizontally with respect to the recording medium, error correction means for erasing errors in typed characters printed on the recording medium including an error correcting tape extending along the direction of carriage movement horizontally of the recording medium between spaced tension rollers, the improvement comprising:

(a) means for traversely moving the correcting tape and associated tension rollers from a storage position vertically below the strike position on the recording medium at which a type character error exists, into vertical alignment therewith;

(b) means for impacting a selected character type element against the error correcting tape to erase the error on the recording medium;

(c) means for longitudinally moving the error correcting tape horizontally of the recording medium after the error has been erased while precluding vertical movement of the tape so as to separate the correcting tape from the record medium; and (d) means for transversely returning the correcting tape and associated tension rollers in a downward direction vertically of the recording medium to the storage position, wherein said error correcting means is mounted for movement with said carriage and said means for longitudinally moving said error correcting tape moves said carriage longitudinally while the tape remains stationary with respect to the tension rollers.

* * * * *